US007428861B2

(12) United States Patent
Dettmers et al.

(10) Patent No.: US 7,428,861 B2
(45) Date of Patent: Sep. 30, 2008

(54) VALVE FOR HYDRAULIC PROPS OF SHIELD-TYPE SUPPORT FRAMES, AND SHIELD-TYPE SUPPORT FRAME

(75) Inventors: Michael Dettmers, Kamen (DE); Bernd Peters, Dülmen (DE)

(73) Assignee: DBT GmbH, Lunen (DE)

( * ) Notice: Subject to any disclaimer, the term of this patent is extended or adjusted under 35 U.S.C. 154(b) by 398 days.

(21) Appl. No.: 10/551,932

(22) PCT Filed: May 5, 2004

(86) PCT No.: PCT/EP2004/004766

§ 371 (c)(1),
(2), (4) Date: Oct. 4, 2005

(87) PCT Pub. No.: WO2004/099628

PCT Pub. Date: Nov. 18, 2004

(65) Prior Publication Data

US 2006/0213363 A1 Sep. 28, 2006

(30) Foreign Application Priority Data

May 8, 2003 (DE) ..... 203 07 245
Jun. 23, 2003 (DE) ..... 203 09 693

(51) Int. Cl.
*F15B 16/06* (2006.01)
*E21D 23/26* (2006.01)

(52) U.S. Cl. ..... 91/508; 91/420; 405/302

(58) Field of Classification Search ..... 91/420, 91/508; 405/302
See application file for complete search history.

(56) References Cited

U.S. PATENT DOCUMENTS 3,673,800 A 7/1972 Ashton
4,470,339 A * 9/1984 Tardy ..... 91/420
5,000,622 A * 3/1991 Block ..... 91/420

FOREIGN PATENT DOCUMENTS

DE 3504553 4/1986
DE 19633258 8/1997
DE 19813909 10/1999
DE 20301251 4/2003
EP 0930130 7/1999

* cited by examiner

*Primary Examiner*—F. Daniel Lopez
(74) *Attorney, Agent, or Firm*—Fay Sharpe LLP

(57) ABSTRACT

The invention relates to a valve 120, especially a check valve, for hydraulic plungers (3) of shield-type support frames in underground mining with a valve housing 121 and a switchable valve insert received therein, connections 126-129 for high pressure lines connected to the cylinder chamber and/or the annular space of the hydraulic cylinder 3, and at least one connection 30 for an additional unit such as a pressure relief valve, a pressure sensor, and/or a pressure display. The valve housing 121 can be mounted to the hydraulic cylinder 3, and in the mounting stage, the connections 125-129 on the valve housing 121 extend axially parallel to the axis of the hydraulic plunger 3. According to an advantageous further embodiment, the valve housing can be provided with at least one fastening means for an extension housing 40 that can be mounted in a releasable manner to at least one side wall 22B thereof for additional hydraulic functions of the shield-type support frame (see FIG. 2).

16 Claims, 6 Drawing Sheets

Figure 1:
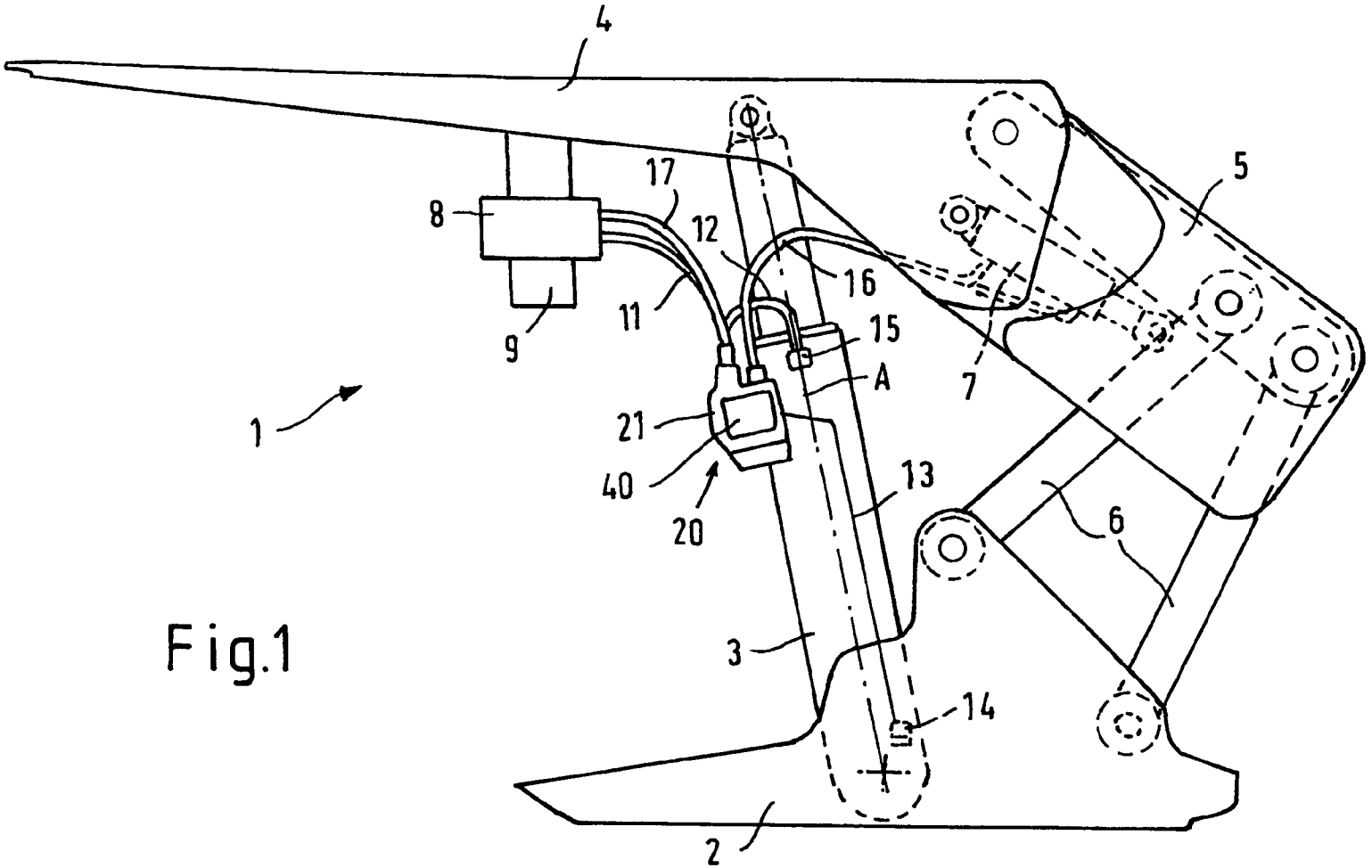

Fig. 2
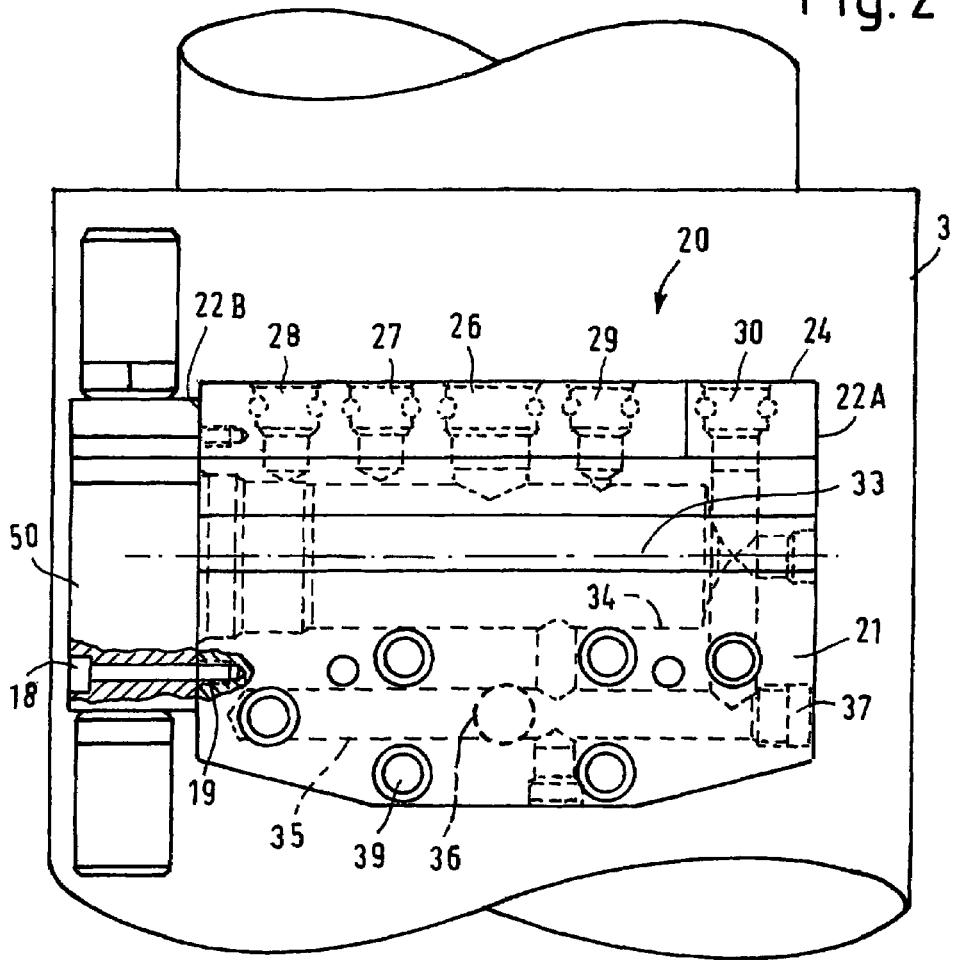
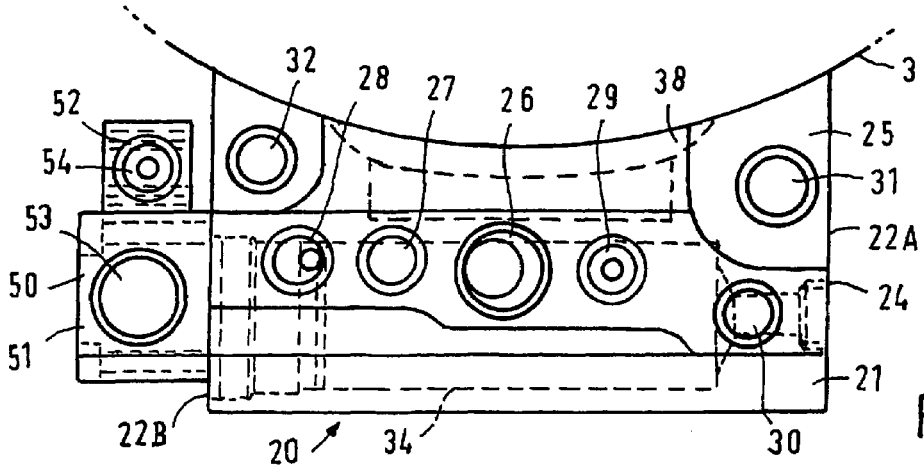
Fig.3

VALVE FOR HYDRAULIC PROPS OF SHIELD-TYPE SUPPORT FRAMES, AND SHIELD-TYPE SUPPORT FRAME

The invention relates to a valve, in particular a check valve, for hydraulic cylinders, in particular for hydraulic plungers in underground mining, with a valve housing and a switchable valve insert received therein, with line connections for high pressure lines connected to the cylinder chamber and/or the annular chamber of the hydraulic cylinder, as well as with at least one connection for an additional unit such as a pressure limiting valve, a pressure sensor, and/or a pressure display, whereby the valve housing can be fixed to the hydraulic cylinder.

Such valves, used for the control of hydraulic plungers at support frames in underground mining, are for example known from DE 19813909A1. The valve formed as check valve serves to prevent that hydraulic fluid can inadvertently leak from the cylinder chamber of the hydraulic plunger. The check valve insert is only opened with regard to the cylinder chamber of the hydraulic plunger when hydraulic fluid with depletion pressure is present in the annular chamber of the hydraulic plunger for the depletion of the shield-type support frame. With the known valves, the valve housing was regularly provided with lateral line connections, which not only resulted in that the high pressure lines between the valve and cylinder or annular chamber had to be dimensioned comparatively long, but which also lead to the drive personnel to possibly be obstructed by the hydraulic lines projecting laterally therefrom during driving onto the prop with small power of the prop to be supported by the support frames. With the known arrangement, there always resulted damages of the high pressure hoses which could lead to dangerous situations and which should actually be prevented under any circumstances.

It is the object of the invention to create a valve of the above-mentioned type with which the length of the high pressure lines between the valve housing and plungers can be limited to a minimum and with which obstructions of the drive personnel can be avoided and damages of the high pressure lines can be eliminated effectively.

This object is solved by means of the invention in that the connections for the lines and hoses run axially parallel to the axis of the hydraulic cylinder in its position fixed to the hydraulic cylinder. It is particularly advantageous if the connections at the valve housing are arranged at the top at the valve housing in its position fixed at the hydraulic cylinder.

This constructive design allows the shortening of the hydraulic hoses between the valve housing and the hydraulic cylinder in their length to a minimum. They then cannot anymore project into the drive path and obstruct the operational personnel of the props during the driving onto it. Damages of the hoses are excluded as far as possible due to their small length.

In an advantageous continuation of the invention, the inner side of the valve housing facing the hydraulic cylinder in the mounted state of the valve is adapted to the outer contour of the cylinder, so that the valve housing can abut the cylinder essentially without a gap. The valve housing is preferably provided with a recess at its inner side of the plunger side which overlaps a fastening plate arranged at the hydraulic cylinder in the mounted state of the valve. The valve according to the invention can then be mounted in the way of an exchange instead of an older present valve, by mounting it to the fastening plate already present at the plunger. The retrofitting of plungers within the scope of repair tasks is thereby possible without a problem.

It is of particular advantage if the fastening plate comprises a hydraulic inlet to the cylinder chamber of the hydraulic plunger.

The valve housing is conveniently provided with at least one transverse bore for the reception of a fastening screw which can be screwed into an associated thread bore at the hydraulic cylinder through the transverse bore. Practically, four transverse bores are usually provided for four fastening screws, with which a simple and safe fastening of the valve at the plunger can then be carried out.

A particularly advantageous arrangement, as it is space-saving, results when the connections at the valve housing are arranged in at least two stages, with a first, lower stage near the inner side and a second higher stage near the outer side of the valve housing. The connections in the lower stage are thereby particularly protected between the plunger outer wall and the front connection bank forming the second, higher stage. The arrangement is preferably made in such a manner that the connections for the high pressure lines and/or for the pressure display are arranged in the higher stage, which can be reached particularly easily, while the connections for the pressure limiting valve and/or the pressure sensor can be found in the lower stage, so that the pressure limiting valve and the pressure sensor are arranged in a particularly protected manner. The lower stage can conveniently be formed by countersinks at the upper side of the valve housing, whereby its production is possible in a simple and fast manner.

Transverse bores for the reception of U-shaped locking clamps are preferably assigned to the connections respectively in pairs, as they are known and proven for the securing of the connections of hydraulic lines or hydraulic units in underground mining. The side of the valve housing facing the connections can comprise a chamfer and the valve housing can be provided with a recess in the region in front of the higher stage, whereby both measures contribute to a weight reduction of the valve without influencing its reliability in a negative manner.

According to a further advantageous aspect of the invention, the application possibilities of the valve formed in particular as check valve are improved, in that the check valve, in particular its valve housing, comprises at least one fastening means for an extension housing mountable in a releasable manner to one of the side walls of the valve housing for additional hydraulic functions of the shield-type support frame. By this additional measure, the check valve can be used at various shield-type support frames, and at the same time, there consists an extension possibility for switching or control housings, with which hydraulic lines and function elements can be coupled to one another for the control of additional functions at the shield-type support frame. A condition for the lateral attachment of extension housings is the axially parallel delivery of the high pressure lines and connections, as only then there is sufficient space at the side walls of the valve housing for the fastening of extension housings.

In a particularly preferred embodiment, extension housings for realising different control functions for the shield-type support frame can be added here to both side walls of the valve housing. The fastening means can in particular consist of thread bores in one or, corresponding to the preferred embodiment, both side walls of the valve housing. Furthermore preferably, the valve housing comprises a hydraulic outlet to the cylinder chamber of the hydraulic plunger at the rear side or at the bottom side. If the hydraulic outlet is formed at the rear side, particularly in the fastening plate of the valve housing, an additional hose line can be foregone.

In one embodiment, the extension housing can comprise a hose connection and connection receptions for function elements for activating a corner cylinder of the shield-type support frame, whereby the extension housing can in particular have a reception bore for a pressure control valve as function element for activating the corner cylinder. The operating mode and the addition of a corresponding pressure control valve for activating the corner cylinder are known from DE 3504553C1, the disclosure content of which is referred to herein.

The extension housing can alternatively be provided with connection receptions for function elements for controlling a movement of only one horizontal skid of the shield-type support frame. For this, the extension housing can particularly comprise connection receptions for a pressure limiting valve and a hydraulically non-shutting check valve and possibly a preferably manually operated relief valve. So as to connect the extension housing for controlling a corner cylinder or the extension housing for lifting one of the horizontal skids hydraulically to the high pressure lines or connections in the valve housing, one side wall of the valve housing is provided with a shut-off connection bore connected to the high pressure connection for the cylinder chamber, with a shut-off connection bore connected to the high pressure connection for the annular chamber and/or with a shut-off connection bore connected to the hydraulic outlet, so that all switching states of the check valve can also be coupled into the extension housing depending on the needed function. The extension housing is then conveniently provided with a connection channel arranged flush with the annular chamber connection bore at the housing wall facing the valve housing. Depending on the function to be actuated, the housing wall of the extension housing can additionally comprise a connection channel arranged flush with the cylinder chamber connection bore or the hydraulic connection bore.

Further preferably, an extension housing provided with a pressure intensifier can be connectable or connected to the valve housing, in particular at the facing side wall, whereby the pressure intensifier preferably comprises an oscillating amplifier piston. The pressure intensifier can in particular be formed in its construction and in its operating mode as is disclosed in DE 19633258C2, the contents of which are explicitly referred to here for complementing the present disclosure. It is particularly advantageous if the extension housing for the pressure intensifier comprises connection receptions for a throttle preceding the low pressure inlet of the pressure intensifier and for a pressure reducing valve, so as to keep the pressure level at the inlet of the proportional hydraulic pressure intensifier or amplifier constant. For the addition of an extension housing with pressure intensifier it is of particular advantage if the side wall of the valve housing comprises a first shut-off connection bore connected to the hydraulic outlet and a second connection bore connected to the high pressure line connection for the cylinder chamber.

The bottom side of the valve housing can preferably comprise a chamfer so that the hydraulic plungers can be retracted and possibly lowered without the valve housing preventing the lowering movement.

The invention also relates to a shield-type support frame with horizontal skids, with a canopy, with telescopic hydraulic plungers supporting the canopys with regard to the horizontal skids, and with a check valve assigned to every hydraulic plunger, which check valve is formed as described above.

Figure 4:
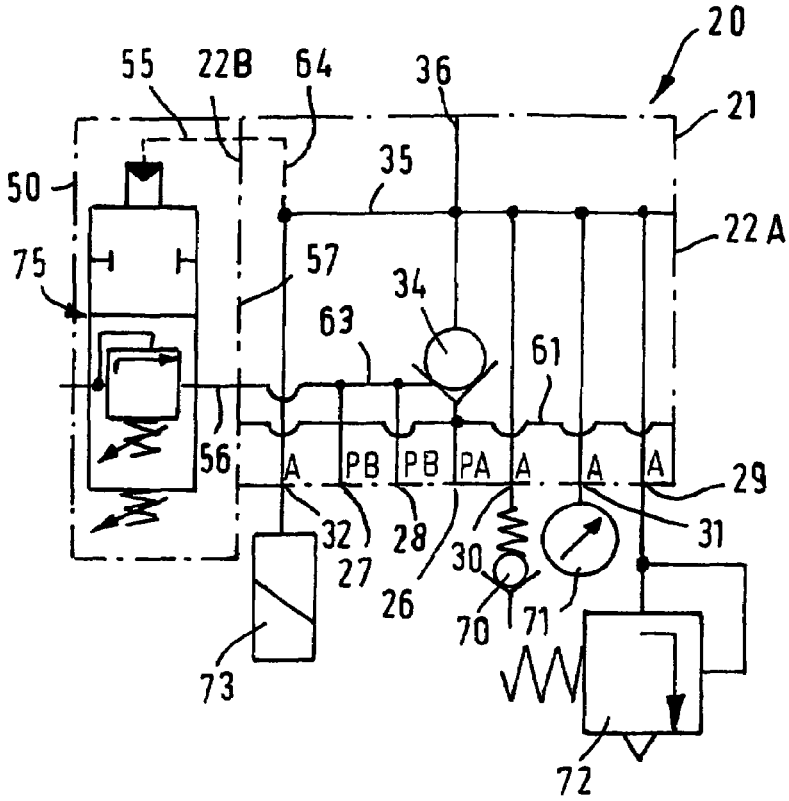
Figure 5:
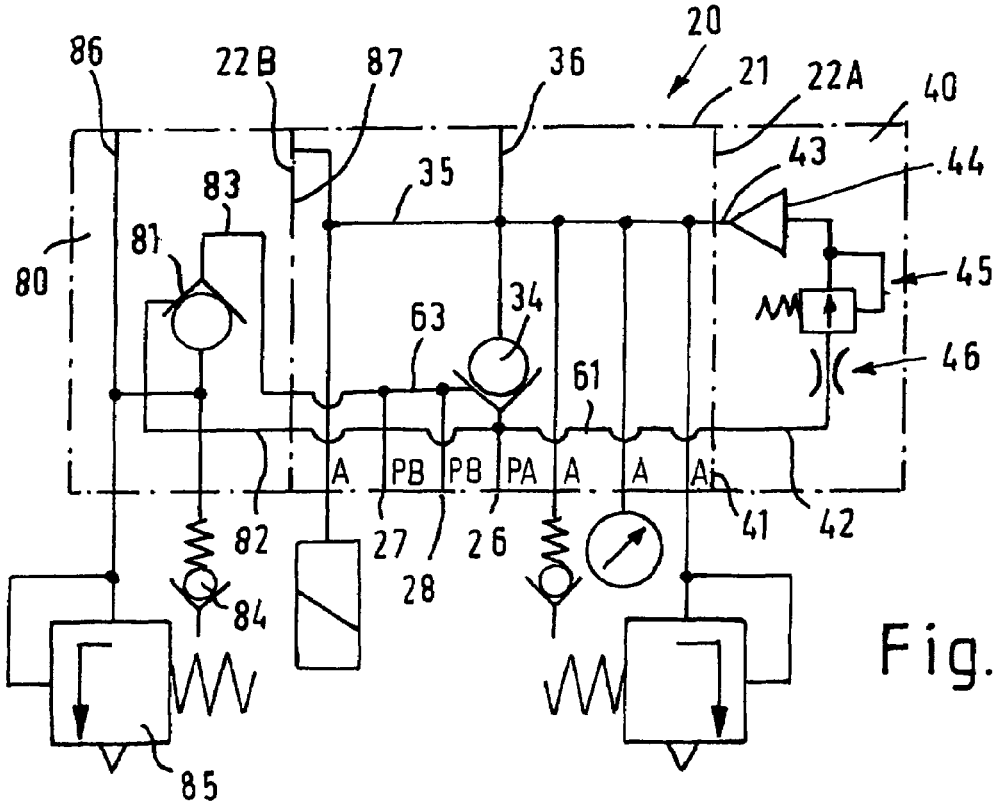
Figure 6:
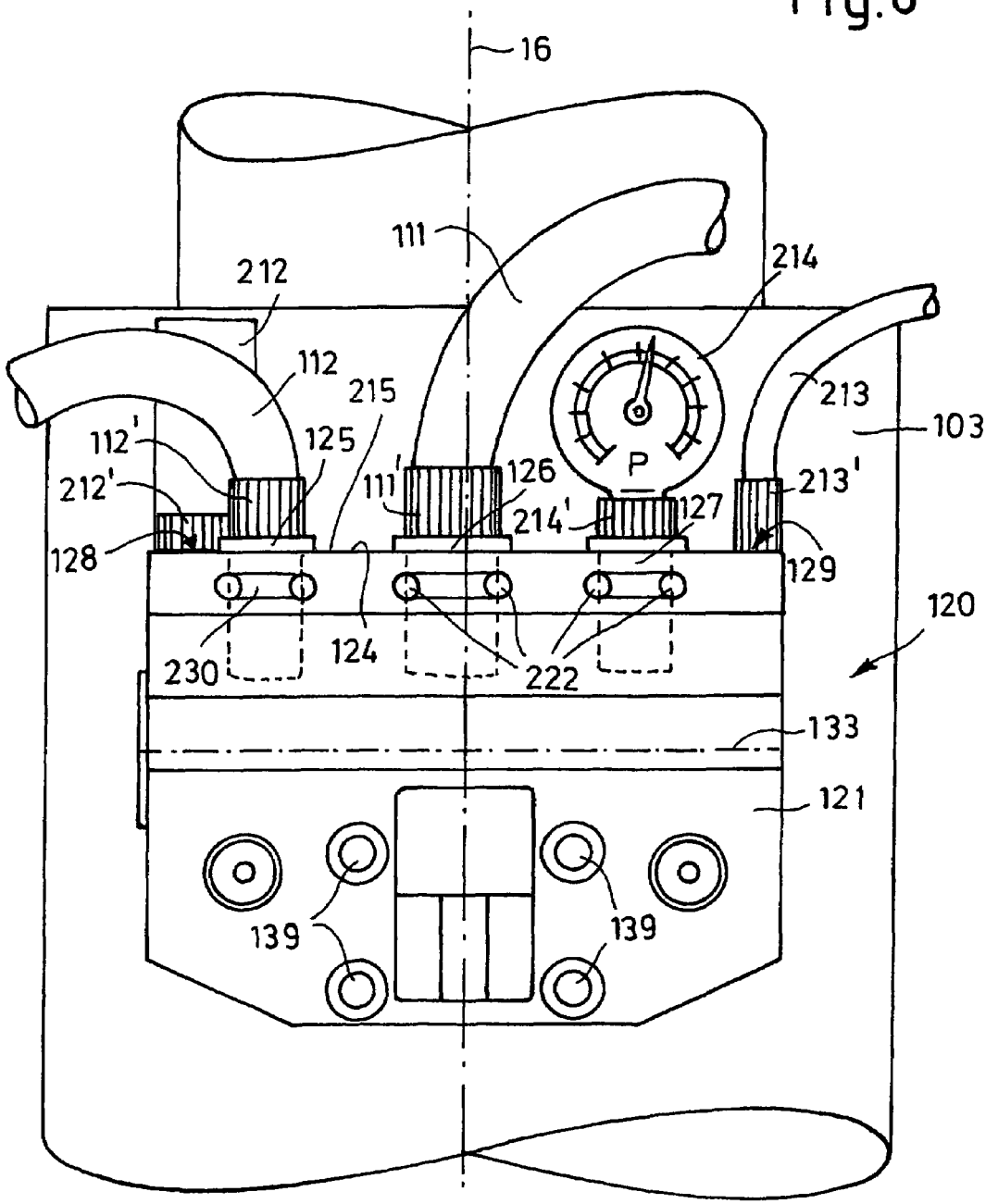
Figure 7:
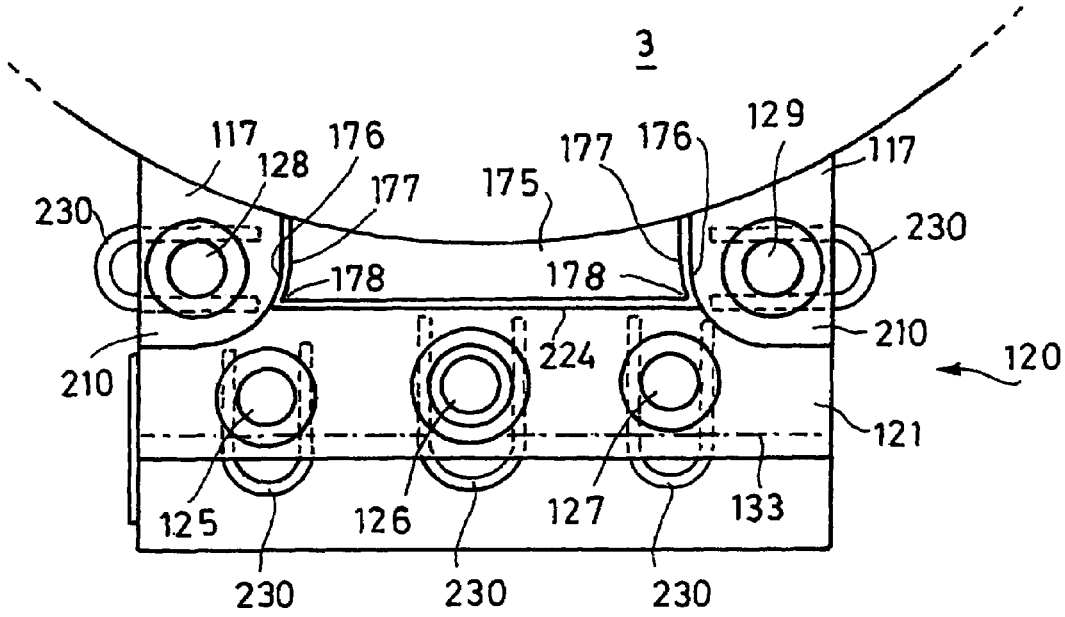
Figure 8:
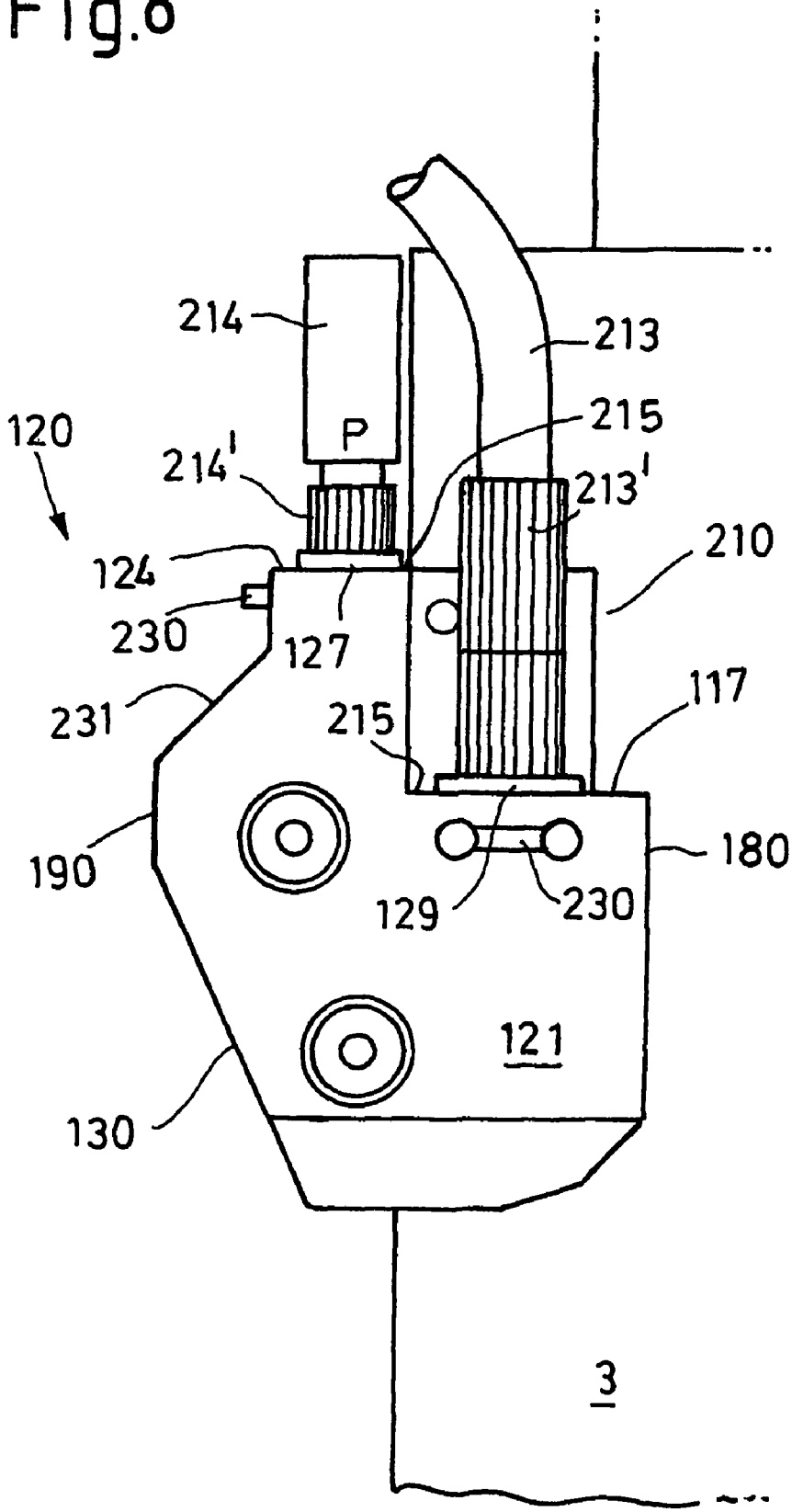

Further characteristics and advantages of the invention result from the following description and the drawing, where preferred embodiments of the invention are explained in more detail with the help of examples. It shows:

FIG. 1 schematically in simplified depiction a hydraulic shield-type support frame in side view with a check valve with added extension housing secured to the hydraulic plunger according to a first embodiment;

FIG. 2 a check valve with mountable extension housing for activating a corner cylinder at the shield-type support frame schematically in the view to the front side f the check valve housing;

FIG. 3*a* top view of the check valve of FIG. 2;

FIG. 4 the hydraulic construction of the check valve and the added extension housing for the activation of the corner cylinder in a hydraulic block diagram;

FIG. 5 a check valve with an extension housing added to the left for activating only one horizontal skid and with an extension housing added to the right for a pressure intensifier in a hydraulic block diagram;

FIG. 6 a check valve according to the invention in a state added to a hydraulic plunger in a front view according to a second embodiment without extension housing;

FIG. 7 the object of FIG. 6 in a top view, but without the high pressure lines and, additional units shown in FIG. 6; and FIG. 8 the object of FIG. 6 in a side view.

FIG. 1 shows in a schematically simplified manner a hydraulic shield-type support frame 1 for use in underground mining operations, in particular in prop operations for the mining of coal. The shield-type support frame 1 includes two horizontal skids 2 arranged in a parallel adjacent manner in the initial position of the shield-type support frame 1, at which skids is supported a telescopic and hydraulic cylinder or hydraulic plunger 3 loadable with hydraulic pressure on both sides for supporting the roof canopy 4 with its lower end. A break shield 5 is guided to the roof canopy 4 in an offset manner, which shield is connected to the horizontal skids 2 by means of respectively two guides 6, so as to guide the roof canopy 4 with regard to the horizontal skid 2 in an upwardly pivotal manner according to a lemniscate gear. A corner cylinder 7 which can be loaded at both sides is arranged between the break shield 5 and the roof canopy 4, with which cylinder the angular position of the roof canopy 4 can be changed.

For controlling different functions of the shield-type support frame 1, a hydraulic control block 8 and an electronic activating device 9 are secured to the bottom side of the roof canopy 4, whereby the electrically actuatable added valves arranged in the control block 8 are actuated by activating signals of the electronic activating device 9. At the front side of the cylinder of the hydraulic plunger 3 facing the mining thrust is arranged the valve housing 21 of a check valve according to the invention designated as 20 altogether, which receives a horizontal check valve insert in the view according to FIG. 1, and the connections of which, as can be seen well in FIG. 1, are parallel to the axis A of the hydraulic plunger 3, so that the hose lines such as the high pressure line 11 for the cylinder chamber of the hydraulic plunger 3 or the high pressure feed line 12 to the annular chamber of the hydraulic plunger 3 can also be guided to the check valve 20 parallel to the axis A of the hydraulic plunger 3. As can be seen further from FIG. 1, the check valve 20 comprises a hydraulic outlet at the rear side abutting the cylinder of the hydraulic plunger 3, which outlet leads to the schematically shown cylinder chamber connection 14 by guide channels 13 arranged in the wall of the hydraulic plunger 3. The annular chamber connection 15 is arranged at the hydraulic plunger 3 at the outside and laterally thereof. The pressure load of hydraulic fluid to the annular chamber for depleting the hydraulic plunger takes place by a valve switched separately in the control block 8 as well as by the high pressure line 17 which leads to the check valve 20 and is there diverted internally to the feed line 12.

The activation of certain functions of the corner cylinder 7 takes place in an extension housing arranged at the rear side wall of the valve housing 21 of the check valve 20 with further hydraulic function elements, as well as the hose line 16. A further extension housing 40 is secured to the front side wall of the valve housing 21 of the check valve 20 in a releasable manner, in which a hydraulic pressure amplifier with an oscillating amplifier piston is arranged.

FIGS. 2 and 3 show the check valve 20 in the mounting state at the hydraulic plunger 3, whereby the hose lines and the hydraulic lines are not shown and no extension housing is secured to the right side wall 22A of the valve housing 21. The valve housing 21 includes, as shown particularly in FIG. 3, a front higher stage 24 and a rear stage 25, whereby the line connection 26 for the high pressure line to the cylinder chamber is arranged centrally at the upper stage 24 and adjacent to this are arranged two line connections 27 and 28 for the high pressure line and the feed line to the annular chamber of the hydraulic plunger 3. The valve housing 21 further includes a connection 29 in the upper stage 24 for a pressure gauge, a further connection 30 for a manual control valve, as well as a connection 31 for a pressure limiting valve and a connection 32 for a pressure sensor in the rear, lower plane 25. The valve housing 31 is provided with a chamfer at the transition of the front to the bottom side.

All connections 26 to 32 lead to a central reception bore for a schematically indicated check valve insert 34 arranged on the horizontal axis 33, below which is formed a connection bore 35 which leads to the rear or inner side hydraulic outlet 36 of the check valve 20. The connection bore 35 is shut with a closure plug 37 at the side wall 22A. The valve housing 21 is secured to a fastening plate, not shown, provided at the hydraulic plunger 3 which grips a recess 38 at the rear side of the valve housing 21, and for the latching of the valve housing 21 to the plunger 3, fastening screws are screwed through the transverse bores 39 into the fastening plate at the hydraulic plunger 3. The rear or inner side 39 of the valve housing is adapted to the cylindrical contour of the hydraulic plunger 3.

At the left side wall 22B of the valve housing 21 is secured an extension housing 50 for activating the corner cylinder (7, FIG. 1) of the shield-type support frame in a releasable manner, whereby fastening screws 18 serve as fastening means, which can be screwed through bores in the extension housing 50 into thread bores 19 at the side wall 22B of the valve housing 21. Corresponding thread holes are also formed in the side wall 22A, so as to be able to secure another extension housing there, as in particular an extension housing with a pressure amplifier. The extension housing 50 includes again a front stage 51 and a rear stage 52 with connection receptions 53 and a hose connection 54 for different function elements for activating the corner cylinder of the shield-type support frame. The connection receptions 53 and the hose connection 54 run axially parallel to the connections 26 to 32 in the valve housing 21 and thereby also axially parallel to the axis of the hydraulic plunger 3. A hydraulically actuatable pressure control valve is arranged in the connection receptions 53 formed at the upper and lower side of the extension housing 50 and a longitudinal bore aligned flush therewith, which valve responds during the retracting process of a shield-type support frame, when traction forces are effective on the corner cylinder and then controls the pressure in the function of a pressure limiting valve to a lower adjustment pressure of about 100 bar. The pressure control valve then keeps the roof canopy (4, FIG. 1) in the taken position, and simultaneously allows an adaption, when, during convergence, the angular position of the roof canopy to the horizontal skid changes during the stroke. The construction of such a pressure control valve for the corner cylinder is described in detail in DE 3504553C2, which is referred to for completing the present disclosure.

FIG. 4 shows the check valve according to FIGS. 2 and 3 with the pressure control valve 75 arranged in the extension housing 50 in a hydraulic block diagram, and the inner construction of the check valve 20 shown in FIGS. 2 and 3 is now explained with reference to the block diagram. The line connections 27 and 28 for the annular chamber (PB) of the hydraulic plunger and the line connection 26 for the set pressure high pressure line for the cylinder chamber ($P_A$) of the hydraulic plunger 3 can be seen in the block diagram. The hydraulic outlet 36 to the cylinder chamber is shown at the rear side of the valve housing 21. A stop valve 70 is connected to the connection 30, a pressure gauge 71 to the connection 31, a pressure limiting valve 72 to the connection 29, and a pressure sensor 73 to the connection 32. At the right housing wall 22A, the connection bore 35 connected to the hydraulic outlet 36 as well as the connection bores 61 connected to the line connection 26 are shut by closure plugs, not shown further. The check valve insert 34 is arranged between the connection bores 35, 61 and thereby between the high pressure inlet 26 and the hydraulic outlet 36, which insert can only be hydraulically opened with hydraulic fluid for the annular chamber ($P_B$) at depletion pressure. The connection bore 61, a connection bore 63 connected to the high pressure line connection 28 for the annular chamber, as well as a control channel 64 connected to the hydraulic outlet 36 and the connection bore 35 lead to the side wall 22B of the valve housing 21, where the extension housing 50 with the hydraulically switchable control valve 75 is arranged. In the extension housing 50 are formed connection channels 55 leading to the housing wall 57 flush with the connection bores 64, 63 leading to the side wall 22B for actuating the pressure control valve 75 and 56, so as to be able to control the corner valve in the desired manner. A connection to the connection bore 61 is not needed for the extension housing 50, and is shut.

FIG. 5 shows a check valve 20 in a further block diagram, at the valve housing 21 of which is secured an extension housing 40 with a pressure intensifier at the side wall 22A, as well as an extension housing 80 with function elements for reaching the lifting of a horizontal skid at the side wall 22B. The check valve 20 comprises the same connections and function components as described with reference to FIG. 4, so that a new description will not take place here. A first connection channel 42 is arranged in the extension housing 40, which is secured to the side wall 22A of the valve housing 21 by fastening screws, at the housing wall facing the valve housing 21, which connection channel is aligned in a flush manner with the connection bore 61 which leads to the high pressure connection 26 for the cylinder chamber of the hydraulic plunger, and a second connection channel 43 is formed which is aligned in a flush manner with the connection bore 35 which leads to the hydraulic outlet 36. The connection channel 42 forms the inlet and the connection channel 43 forms the outlet for a pressure intensifier 44 with an oscillating amplifier piston, not shown further, as is for example described in DE 19633258C1. A pressure limiting valve 45 and a throttle 46 are preceding the pressure amplifier 44 hydraulically, whereby these are also arranged in the extension housing 40. Hydraulic fluid can be amplified to almost any high pressures with the pressure intensifier 44 proportionally to the pressure level at the inlet 42.

The extension housing 80 secured to the side wall 22B by means of suitable thread screws includes a hydraulically non shut-off check valve 81, which can be opened if it is actuated with hydraulic fluid with a set pressure for the cylinder chamber (PA) of the hydraulic plunger by means of the connection channel 82 which enters the connection bore 61 at the housing wall 87. In the closed state, the check valve 81 shuts a connection channel 83 which is formed flush with the connection bore 63 which leads to the high pressure line connection 28 of the annular chamber. A stop valve 84 is assigned to the check valve 81 in suitable connection receptions at the extension housing 80 and a pressure limiting valve 85 in a further connection reception, and the extension housing 80 comprises a line connection 86 to the annular chamber of the hydraulic plunger. A horizontal skid can be lifted with the function elements arranged in the extension housing 80.

The check valve designated as 120 in its entirety in FIGS. 6 to 8 again serves for actuating a hydraulic plunger 3 of a hydraulic support frame, as is used for the prop support in underground mining. The valve 120 is not provided with an extension housing for controlling additional functions in the shown example of the embodiment.

The check valve 120 consists essentially of a valve housing 121 and a switchable valve insert received therein, the axis of which is designated as 133 and which is arranged in the valve housing 121 in an essentially horizontal bore. The valve housing is provided with connections 125, 126, 127, 128 and 129 for various high pressure lines 112, 111 as well as for additional units, in the present example for a pressure limiting valve 212, a pressure sensor 213 and a pressure gauge 214, whereby the arrangement is implemented in such a manner that all connections 125 to 129 are at the upper side 215 of the valve housing and are aligned axially parallel to the axis 216 of the hydraulic plunger. The various connections are thereby arranged with different heights in two stages at the valve housing 121, whereby the connection 128 for the pressure limiting valve 212 and the connection 129 for the pressure sensor 213 are arranged on the first, lower stage 117 near the inner side 180 of the housing 121 facing the hydraulic plunger 3, while the three connections 125; 126, 127 for the two high pressure lines 112, 111 to the cylinder chamber and to the annular chamber of the hydraulic plunger 3 and for the pressure gauge 214 are arranged in a row next to one another at the higher stage 124 situated nearer to the outer side 190 of the valve housing. The lower stage 117 does thereby not pass entirely through the entire width of the valve housing 121, but is formed by countersinks 210 which are respectively inserted from the two sides of the valve housing up to a depth which permits the reception of the plug parts of the units to be connected.

So as to secure the high pressure lines 111, 1112 and the further units 212, 213, 214 to the connections 125 to 129 with their respective plug parts 112', 111', 212', 213', 214', they have transverse bores 222 respectively arranged in pairs assigned thereto, into which can be inserted U-shaped locking clamps 223 which fit into grooves in the plug parts with their two legs in the inserted state and lock these in a positive manner in the connections, as is known in mining hydraulics.

It can be seen that the valve housing 121 is secured to the hydraulic plunger 3. For this, it is provided with a recess 224 at its inner side 180 on the side of the plunger which is adapted to the outer contour of the plunger 3, which recess overlaps a fastening plate 175 arranged at the hydraulic plunger 3. The fastening plate is formed in the mode of a dovetail guide tapering upwardly in a trapezoidal manner and the recess 224 is adapted to this form. The valve housing with its recess 224 can thereby be slid from above onto the fastening plate 175, until the side surfaces 176 or 177 tapering in a trapezoidal manner come together in abutment during the sliding process from the recess 224 or fastening plate 175 and then prevent a further sliding. The laterally projecting dovetail-shaped front edges 178 of the fastening plate prevent then that the housing can be pulled off laterally transverse to the axial direction of the plunger.

So as to secure the housing 121 additionally to the plunger, it is provided with four transverse bores 139 which are flush with thread bores arranged in the fastening plate when the valve housing is slid entirely onto the fastening plate with its recess. Fastening screws can then be screwed into the thread bores at the fastening plate through the transverse bores.

For saving weight, the valve housing is provided with a chamfer 130 at the bottom or front side facing the connections. For the same reason, a recess 231 is provided in the region in front of the higher stage, which, together with the chamfer 130, cater for a particularly light ad compact construction as well as only a small projecting construction of the check valve from the cylinder surface.

It can be seen, that, by the arrangement of all connections 125 to 129 at the upper side of the valve housing, the high pressure lines and the other units to be arranged thereon project axially parallel to the axis of the hydraulic plunger from the valve housing which permits to shorten the length of the hoses to the cylinder and annular chamber of the plunger with regard to the known arrangements, and which in particular takes the hoses out of the drive path of the operational personnel, so that obstructions of the personnel is avoided and the danger of damaging the hoses is reduced.

From the above description result a number of deviations for the expert which are to be included within the scope of the protection of the depending claims. None or the above-described extension housings can be secured to the check valve in an approximately arbitrary combination; furthermore extension housings with other functions could be secured. The check valve can be provided with more or less connection bores.

The invention claimed is:

1. A check valve, adapted for use with hydraulic cylinders, the valve comprising a valve housing and a switchable valve insert received therein, with at least one connection for a high pressure line connected to at least one of a cylinder chamber and an annular chamber of the hydraulic cylinder, the valve further comprising at least one connection for an additional unit selected from the group consisting of a pressure limiting valve, a pressure sensor, and a pressure display, wherein the valve housing is fixable to the hydraulic cylinder, and wherein the connections run axially parallel to the axis of the hydraulic cylinder in its position fixed to the hydraulic cylinder, the inner side of the valve housing facing the hydraulic cylinder in the mounted state of the valve is adapted to the outer contour of the hydraulic cylinder, the valve housing is provided with a recess at its cylinder-side inner side, which overlaps a mounting plate arranged at the hydraulic cylinder in the mounted state of the valve.

2. The valve according to claim 1, wherein the mounting plate comprises a hydraulic inlet to the cylinder chamber of the hydraulic plunger.

3. The valve according to claim 1, wherein the connections at the valve housing are arranged at the top at the valve housing in its position fixed at the hydraulic cylinder.

4. The valve according to claim 1, wherein the inner side of the valve housing facing the hydraulic cylinder in the mounted state of the valve is adapted to the outer contour of the hydraulic cylinder.

5. The valve according to claim 1, wherein the side of the valve housing facing the connections comprises a chamfer or the bottom side of the valve housing comprises a chamfer.

6. A check valve, adapted for use with hydraulic cylinders, the valve comprising a valve housing and a switchable valve insert received therein, with at least one connection for a high pressure line connected to at least one of a cylinder chamber and an annular chamber of the hydraulic cylinder, the valve further comprising at least one connection for an additional unit selected from the group consisting of a pressure limiting valve, a pressure sensor, and a pressure display, wherein the valve housing is fixable to the hydraulic cylinder, and wherein the connections run axially parallel to the axis of the hydraulic cylinder in its position fixed to the hydraulic cylinder, the connections are arranged in at least two stages at the valve housing, with a first, lower stage near the inner side and a second, higher stage near the outer side of the valve housing.

7. The valve according to claim 6, wherein the connections for the high pressure lines and/or for the pressure display are arranged in the higher stage.

8. The valve according to claim 6, wherein the connections for the pressure limiting valve and/or the pressure sensor are arranged in the lower stage.

9. The valve according to claim 6, wherein the connections at the valve housing are arranged at the top at the valve housing in its position fixed at the hydraulic cylinder.

10. The valve according to claim 6, wherein the inner side of the valve housing facing the hydraulic cylinder in the mounted state of the valve is adapted to the outer contour of the hydraulic cylinder.

11. The valve according to claim 6, wherein the side of the valve housing facing the connections comprises a chamfer or the bottom side of the valve housing comprises a chamfer.

12. A check valve, adapted for use with hydraulic cylinders, the valve comprising a valve housing and a switchable valve insert received therein, with at least one connection for a high pressure line connected to at least one of a cylinder chamber and an annular chamber of the hydraulic cylinder, the valve further comprising at least one connection for an additional unit selected from the group consisting of a pressure limiting valve, a pressure sensor, and a pressure display, wherein the valve housing is fixable to the hydraulic cylinder, and wherein the connections run axially parallel to the axis of the hydraulic cylinder in its position fixed to the hydraulic cylinder, comprising at least one fastening means for an extension housing which is mounted in a releasable manner to one of the side walls of the valve housing for additional hydraulic functions of a shield-type support frame, the extension housing comprises a hose connection and connection receptions for function elements for actuating a corner cylinder of the shield-type support frame.

13. The valve according to claim 12, wherein the extension housing comprises a reception bore for a pressure control valve as a function element for actuating the corner cylinder.

14. The valve according to claim 12, wherein the extension housing is provided with connection receptions for function elements for controlling a movement of only one horizontal skid of the shield-type support frame.

15. The valve according to claim 12, wherein the valve housing comprises a hydraulic outlet to the cylinder chamber of the hydraulic cylinder at the rear side or at the bottom side.

16. The valve according to claims 12, wherein the hose connections and the connection receptions are axially parallel to the hydraulic cylinder.

* * * * *